US005818294A

United States Patent [19]

Ashmore, Jr.

[11] Patent Number: 5,818,294

[45] Date of Patent: Oct. 6, 1998

[54] TEMPERATURE INSENSITIVE CURRENT SOURCE

[75] Inventor: Benjamin Howard Ashmore, Jr., Austin, Tex.

[73] Assignee: Advanced Micro Devices, Inc.

[21] Appl. No.: 683,373

[22] Filed: Jul. 18, 1996

[51] Int. Cl.[6] ..... G05F 3/26

[52] U.S. Cl. ..... 327/543; 327/198; 323/315

[58] Field of Search ..... 327/513, 512, 327/538, 543, 548, 198; 323/315, 312, 317

[56] References Cited

U.S. PATENT DOCUMENTS

| | | | |
|---|---|---|---|
| H743 | 2/1990 | Bismark | 327/540 |
| 4,450,367 | 5/1984 | Whatley | 323/315 |
| 4,636,742 | 1/1987 | Oritani | 330/256 |
| 4,645,648 | 2/1987 | Morris et al. | 327/513 |
| 4,769,589 | 9/1988 | Rosenthal | 323/313 |
| 4,792,748 | 12/1988 | Thomas et al. | 323/312 |
| 4,800,365 | 1/1989 | White et al. | 341/119 |
| 5,034,626 | 7/1991 | Pirez et al. | 327/513 |
| 5,204,612 | 4/1993 | Lingstaedt | 323/317 |
| 5,352,934 | 10/1994 | Khan | 323/315 |
| 5,539,341 | 7/1996 | Kuo | 326/21 |
| 5,587,655 | 12/1996 | Oyabe et al. | 323/315 |
| 5,604,427 | 2/1997 | Kimura | 323/907 |
| 5,604,467 | 2/1997 | Matthews | 323/907 |
| 5,631,600 | 5/1997 | Akioka et al. | 327/543 |
| 5,635,869 | 6/1997 | Ferraiolo et al. | 327/543 |

OTHER PUBLICATIONS

Holt, Charles a., *Electronic Circuits Digital and Analog*, John Wiley & Sons, 1990, pp. 483–484.

*Primary Examiner*—Timothy P. Callahan
*Assistant Examiner*—Terry L. Englund
*Attorney, Agent, or Firm*—Kevin L. Daffer; Conley, Rose & Tayon

[57] ABSTRACT

A circuit is presented which can produce a temperature insensitive, constant current value. The constant current source comprises transistor pairs which mirror a temperature dependent current into a node along with another temperature dependent current. The node thereby receives two temperature dependent currents, wherein one is inversely dependent to that of the other. More specifically, one current increases as temperature increases, whereas the other current decreases as temperature increases. The two currents may thereby be construed to offset one another such that the output of a common node produces a current output which does not change with either an increase or decrease in temperature imputted upon the current source component.

19 Claims, 2 Drawing Sheets

TEMPERATURE INSENSITIVE CURRENT SOURCE

BACKGROUND OF THE INVENTION

1. Field of the Invention

This invention relates to an electronic circuit and more particularly to an electronic circuit configured as a temperature insensitive current source.

2. Description of the Relevant Art

Current sources are found in many applications. For example, a current source may be used in various circuits which either sense or amplify a signal. Ideally, a constant current source is one which does not vary regardless of the load resistance or voltage applied across the source terminals. The ideal current source must be capable of supplying any necessary voltage across its terminals. A practical current source, however, is limited to the voltage in which it can provide, often called the "compliance" factor. In addition, a constant current source in actuality cannot provide absolutely constant output current. There are many factors which can affect the attempted constant current, one of which is temperature.

A current source can be configured in numerous ways. An example of one way in which to form a current source is to connect the gates or bases of two matched transistors (i.e., transistors having the same size or beta). One of the two matched transistors is preferably connected as a diode, and the other of the two matched transistors includes a resistor within the current path of that transistor. An example of this popular current source is shown in reference to Holt, *Electronic Circuits Digital and Analog* (John Wiley and Sons), pp. 483–484 (herein incorporated by reference).

A problem inherent with conventional current sources is the dependence of the sourced output to temperature. Instead of a constant current source output, conventional sources produce a current which varies as a function of temperature. This dependence on temperature is based on the principal that characteristics of components which form the source, or which form the load, change as temperature changes.

The concept by which component performance changes as a function of temperature is particularly founded in the field of semiconductor technology. For example, modern semiconductor pn junctions are fabricated by a diffusion or implantation process. This process imparts negative immobile charges (acceptors) and positive immobile charges (donors) within the semiconductor bulk material. When a sufficient number of mobile charges on both sides of the junction are uncovered as a result of applied voltage thereto, a potential energy barrier is created by the uncovered acceptors and donors. This barrier voltage is often expressed according to the following Boltzmann relation:

$$V_0 V_T \ln [P_P/P_N] \quad \text{(Eq. 1)}$$

where $P_p$ is the concentration of holes in the p side of the pn junction and $P_N$ is the concentration of electrons in the n side of the pn junction. $V_T$ is the thermal voltage, often expressed as follows:

$$kT/q \quad \text{(Eq. 2)}$$

where q represents charge density, k represents the Boltzmann constant, and T represents temperature in Kelvin. Charge density q and Boltzmann's constant k are generally non-variable terms, leaving temperature as the primary variable in equation 2 which effects $V_T$ in equation 1.

Depending upon where the pn junction is formed, equations 1 and 2 indicate a relationship between the barrier voltage across the junction and a temperature of that junction. Thus, as the silicon substrate temperature rises, barrier voltage increases accordingly.

SUMMARY OF THE INVENTION

The problems outlined above are in large part solved by a temperature insensitive current source of the present invention. That is, the present current source maintains a substantially constant current regardless of the change in temperature imputed upon components which form the source. Changes in temperature thereby do not deleteriously skew the current source output. Maintaining a constant current source over a broad temperature range proves desirable in many applications which require tight operational tolerance.

Broadly speaking, the present invention contemplates a current source purposefully designed to output a substantially constant current value regardless of the temperature exposed to the current source components, i.e., components formed within a single monolithic substrate or formed from separate and distinct materials. The current source comprises a series-connected first pair of transistors configured to produce a positive temperature dependent current which is mirrored through a first current sourcing transistor. The current source further comprises a series connected second pair of transistors configured to produce a negative temperature dependent current which is mirrored through a second current sourcing transistor. A current source output is coupled to receive a sum of the positive and negative temperature dependent currents from the first and second current sourcing transistors. The sum of the positive and negative temperature dependent currents is derived thereby as temperature independent.

The current source thereby comprises first and second transistors connecting the series between a power supply and a first node. The first pair of transistors, named third and fourth transistors, are connected in series between the power supply and a second node. Transistors are connected in series between the power supply and a third node, and the second pair of transistors comprise seventh and eighth transistors connecting the series between the power supply and a fourth node. The positive temperature dependent current extends through a primary resistor configured between the second node and a ground supply, whereas the negative temperature dependent current extends through a secondary resistor connected between the fourth node and the ground supply.

The second, third, sixth and seventh transistors each comprise mutually connected gate and drain terminals. A first diode is coupled between the first node and the ground supply, whereas a second diode is coupled between the third node and the ground supply. A third diode is included, such that the third diode is coupled in series with the primary resistor between the second node and the ground supply. The voltage at the first node is defined to be equal or substantially equal to a voltage at the second node. The voltage at the third node is defined to be equal to or substantially equal to the voltage at the fourth node. The current through the first node is defined to be equal to or substantially equal to the positive temperature dependent current, and the current through the third node is defined as to be equal to or substantially equal to a negative temperature dependent current.

The positive temperature dependent current is current which increases in magnitude as temperature of the current source, or load applied thereto, increases. The negative temperature dependent current decreases in magnitude as temperature on the current source or load increases. Temperature can increase as a result of, for example, ambient air/environment or operating temperature of the current source. As an example, if the temperature increases as a result of the various transistors, diodes and resistors operating, then the present current source will formulate a current source output which is the result of a positive temperature dependent current offset by the negative temperature dependent current. Thus, as the positive temperature dependent current increases from the rising operating temperature the negative temperature dependent current decreases preferably an equal amount. Of course, the positive and negative temperature dependent currents can be tailored so that, if desired, one need not exactly offset the other. There may be instances in which a designer might chose to retain some temperature sensitivity. In those instances, he or she might make the positive temperature dependent current predominant to the negative temperature dependent current. The opposite, of course, might also apply, if desired. It is understood, however, that the present current source can achieve substantial offsetting currents such that the current source output is either completely or substantially temperature independent.

BRIEF DESCRIPTION OF THE DRAWINGS

Other objects and advantages of the invention will become apparent upon reading the following detailed description and upon reference to the accompanying drawings in which.

Figure 1:
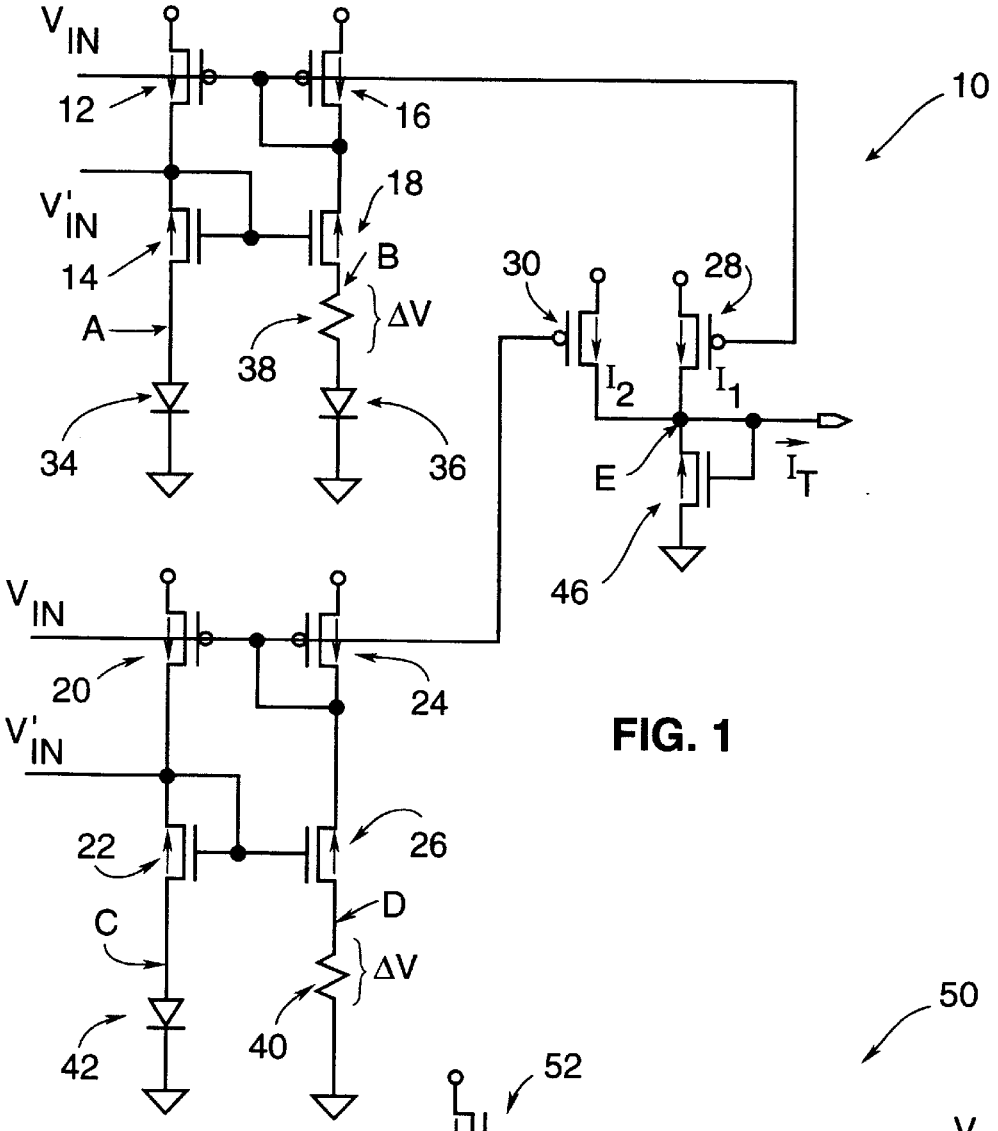
FIG. 1 is a circuit schematic of a temperature insensitive, constant current source of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Turning now to the drawings, FIG. 1 illustrates a temperature insensitive, constant current source 10. Current source 10 includes first and second transistors 12 and 14, respectively, connected in series between a power supply and a first node, denoted in FIG. 1 as A. Connected between the power supply and a second node B is a series connected first pair of transistors comprising third and fourth transistors 16 and 18, respectively. Current source 10 further includes fifth and sixth transistors 20 and 22, respectively, connected in series between the power supply and a third node C. A series connected second pair of transistors, comprising seventh and eighth transistors 24 and 26, respectively, are connected between the power supply and a fourth node D.

The size of transistor 12 is substantially identical to the size of transistor 16. Likewise, the size of transistor 14 is substantially identical to the size of transistor 18. Thus, a voltage $V_{IN}$ and $V_{IN}'$ coupled to the gate terminals of transistors 12, 14, 16 and 18, as shown, provide current mirroring of identical currents through nodes A and B. More importantly, since the transistors are identically sized, the voltage at node A will be substantially the same as the voltage at node B. The same is true for the configuration and result of transistors 20 through 26. Any current through transistors 20 and 22 will be mirrored through transistor 24 and 26 as an equal magnitude thereof. Likewise, the voltage at node C will be the same as the voltage at node D.

The mirrored current through transistors 12 and 14 (or transistors 16 and 18) is denoted as $I_1$. The mirrored current through transistors 20 and 22 (or transistors 24 and 26) is denoted as $I_2$.

Current source 10 further includes a first current sourcing transistor 28 and a second current sourcing transistor 30. According to a preferred embodiment, transistor 28 is sized approximately equal to the size of transistor 12 and, since transistor 12 is sized similar to transistor 16, transistor 28 is sized substantially identical to transistor 16. The same is true for transistors 30, 20 and 24. According to this embodiment, any current through the current path of transistor 16 will be reflected through the current path of transistor 28. Likewise, current within transistor 24 will be mirrored to transistor 20 and to transistor 30. According to an alternative embodiment, the sizes of transistors 28 and 30 can vary not simply with respect to transistors 12 through 18 or transistors 20 through 26, but also with respect to one another. In the latter instance, scaling the sizes of transistors 28 and 30 with respect to the other transistors or with respect to one another affords modification to the amount of temperature insensitivity achieved by the present invention. If scaling is such that the current is mirrored throughout and presented as opposing positive and negative temperature dependent currents $I_1$ and $I_2$ (as shown in FIG. 1), to node E, then the accumulation of $I_1$ and $I_2$ as $I_T$ will be substantially insensitive to current fluctuation. This insensitivity may or may not be desired. Preferably, however, most designers require a temperature insensitive current source which can be formed according to the present configuration.

Current insensitivity is achieved by not only mirroring the current, but by denoting certain principles of operation. More specifically, the area multiplier M of diode 34 is selected to be a particular ratio of the area multiplier M of diode 36. These area multipliers are denoted as $M_{34}$ and $M_{36}$. Given the Boltzmann relation set forth in equations 1 and 2 above, and knowing that the voltage at nodes A and B are equal, the temperature dependent voltage variation across resistor 38 is determined as follows:

$$V_O=(kT/q)*\ln(M_{36}/M_{34}) \quad \text{(Eq. 3)}$$

Knowing the resistive value of resistor 38, the current fluctuation and, more specifically, current $I_1$ if mirroring is desired, is as follows:

$$I_1=\{(kT/q)*\ln(M_{36}/M_{34})\}/R_{38} \quad \text{(Eq. 4)}$$

Equation 4 demonstrates the temperature dependence upon what is deemed a positive temperature dependent current $I_1$. Current $I_1$ is positively dependent on temperature since an increase in temperature will cause an increase in the current value as presented through not only resistor 38 but also through transistor 28.

The change in voltage through primary resistor 38 as a function of temperature also occurs in secondary resistor 40.

However, the temperature dependence is opposite that of resistor 38. While nodes C and D are at the same voltage level as result of current mirroring, the voltage across resistor 40 is therefore a function of the voltage across diode 42. It is commonly known, and documented throughout numerous references, that voltage across a diode such as that configured as diode 42 will decrease as temperature increases. This relationship presents itself in the following equation given that the voltage at nodes C and D are equal:

$$I_2 = V_C / R_{40}. \quad \text{(Eq. 5)}$$

As shown in equation 5, the current through resistor 40 is proportional to voltage $V_C$ at node C, and is inversely proportional to increases in temperature. This current, as mirrored across transistor 30 will denote a negative temperature dependent current $I_2$. A negative temperature dependent current $I_2$ may or may not be directly offset that of positive temperature dependent current $I_1$. Unless sizing of transistors 28 and 30 occur, and in most of the cases $I_1$ current change will not be directly offset by the current change in $I_2$. Therefore, sizing of transistors 28 and 30 may be desired. In either instance, the change in voltage $V_0$ across primary resistor 38 and secondary resistor 40 as a result of temperature is mirrored as positive and negative temperature dependent currents, and thereafter summed as a current source output $I_T$.

Transistors 12, 16, 20, 24, 28 and 30 are preferably p channel MOS transistors, whereas transistors 14, 18, 22, 26 and 46 are n channel MOS transistors. Transistors 14, 16, 22 and 24 are connected as diodes, wherein gate and drain terminals are mutually connected to one another. The power supply, or $V_{DD}$, is a DC voltage greater than the ground supply. According to one embodiment, the power supply can be a voltage dependent upon the process constraints of the circuit being fabricated, a suitable range of operation is approximately 2.0–2.5 in the low range to a voltage of approximately 3.0–5.0, for example. The input voltages $V_{IN}$ and $V_{IN}'$ input to transistors 12 through 18 can also be replicated in input to transistors 20 through 26, as shown. Those input voltages represent any voltage disparity necessary to place desired voltage amounts at the gate terminals of current source 10 transistors. A startup circuit is thereby needed which prevents $V_{IN}$ and $V_{IN}'$ from settling to a non-desired voltage.

Figure 2:
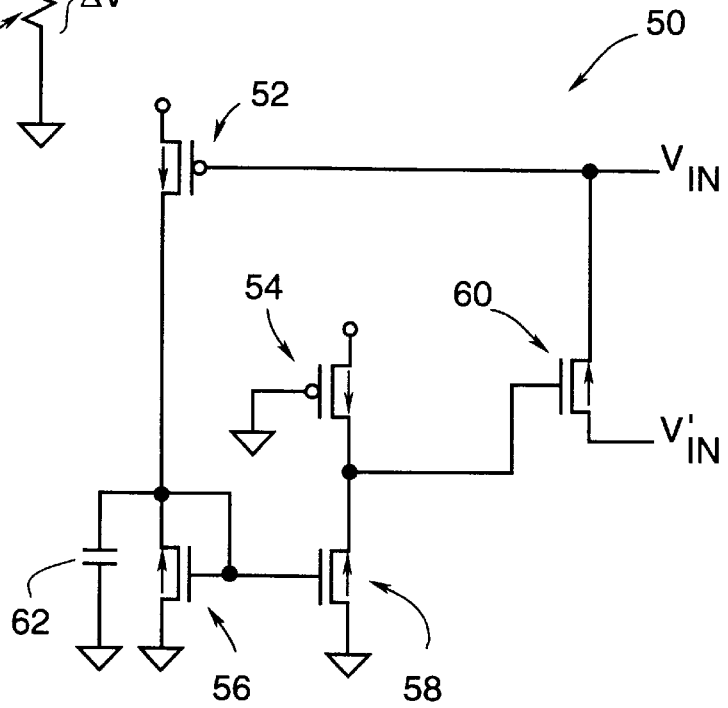
FIG. 2 is a circuit schematic of a starter circuit, according to one exemplary embodiment, configured to connect with the $V_{IN}$ and $V_{IN}'$ input terminals shown in FIG. 1.

FIG. 2 illustrates a started circuit 50 which produces $V_{IN}$ and $V_{IN'}$ to transistors 12 through 18 as well as transistors 20 through 26. $V_{IN}$ is initially driven to a voltage level necessary to activate transistors 12, 16, 20 and 24. Likewise, voltage $V_{IN}'$ is driven to an initial voltage necessary to activate transistors 14, 18, 22 and 26. Thus, voltages $V_{IN}$ and $V_{IN}'$ are chosen to be at an interim level less than 1 threshold voltage below $V_{DD}$ and greater than 1 threshold level above ground. This intermediate voltage can be applied via startup circuit 50, and then removed. Removal of circuit 50 can be achieved without causing harm to the initial startup value as applied to current source 10.

There are possibly numerous configurations of a startup circuit, an exemplary startup circuit 50 is shown in FIG. 2. According to the exemplary embodiment, startup circuit 50 comprises a set of P-channel transistors 52 and 54, and a set of N-channel transistors 56, 58 and 60. Transistor 56 is connected as a diode in parallel with a capacitor 62. A feedback arrangement afforded by a configuration of transistors 52 through 60 ensure that $V_{IN}$ does not rise above one threshold below $V_{DD}$ and that $V_{IN}'$ does not extend below one threshold above ground during initial startup. Ideally, $V_{IN}$ and $V_{IN}'$ are maintained approximately one half $V_{DD}$ during startup.

Numerous other startup circuits may be employed, any of which can achieve the desired voltage output. Regardless of the circuit configuration, current source 10 is ensured of being placed in a proper voltage state during startup, and that voltage state is maintained thereafter.

Figure 3:
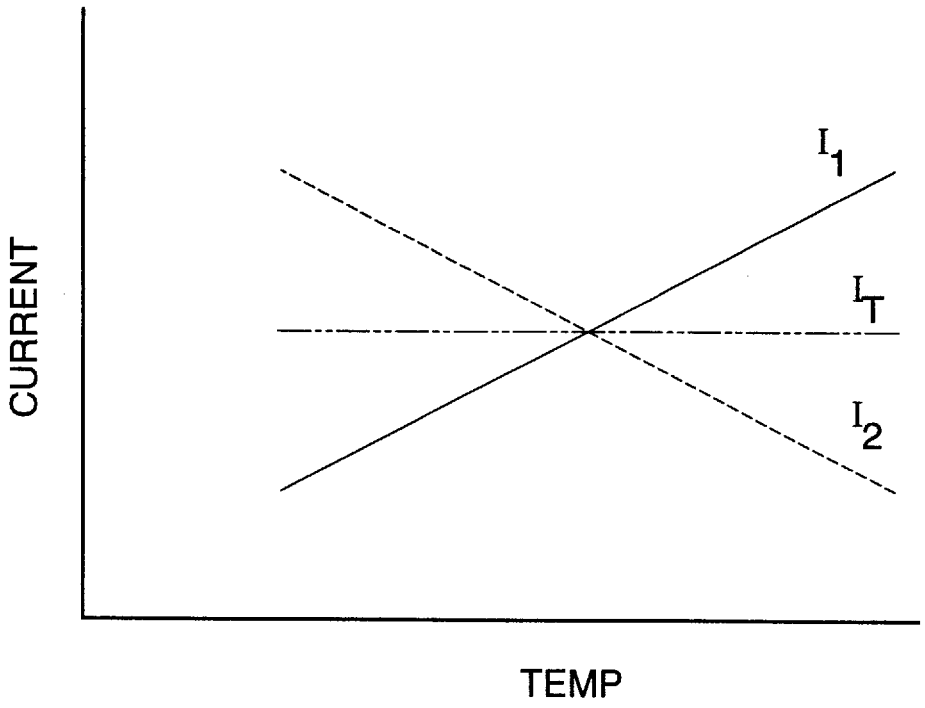
FIG. 3 is a graph of temperature vs. current for indicating the positive and negative temperature dependent currents $I_1$ and $I_2$, respectively, as well as the cumulative current source output $I_T$ resulting from the current source of FIG. 1.

Referring to FIG. 3, a graph of current as a function of temperature for the current source output $I_T$ as well as the positive and negative temperature dependent currents $I_1$ and $I_2$, respectively, are shown. As temperature increases, the positive temperature dependent current is shown to increase. However, as temperature increases, the negative temperature dependent current decreases. Preferably, $I_1$ and $I_2$ rates of current change vs. temperature are converse to one another such that the current source output $I_T$ is constant regardless of the temperature. If desired, however, $I_T$ can be designed to change either positively or negatively with respect to temperature increases. This change is achieved by proper scaling of transistors within current source 10 so as to change the slope of $I_1$ and/or $I_2$. Skewing the slope of these currents can thereby skew the slope from a horizontal path to a slight tilted path if needed.

It will be appreciated to those skilled in the art having the benefit of this disclosure that this invention is believed to be capable of use with any circuit which embodies a constant current source. Furthermore, it is also to be understood that the form of the invention shown and described is to be taken as exemplary, presently preferred embodiments depicting a desired temperature insensitive, constant current source either formed on a single monolithic substrate or as discrete components coupled together in the desired configuration set forth above. Various modifications and changes may be made without departing from the spirit and scope of the invention as set forth in the claims. It is intended that the following claims be interpreted to embrace all such modifications and changes and, accordingly, the specification and drawings are to be construed in an illustrative rather than in a restrictive sense.

What is claimed is:

1. A current source, comprising:

first and second MOS transistors connected in series between a power supply and a first node;

third and four MOS transistors connected in series between said power supply and a second node, wherein a gate terminal of said first and third transistors are mutually connected to a gate of a first current sourcing transistor, and wherein a gate terminal of said second and fourth transistors are mutually connected;

fifth and sixth MOS transistors connected in series between said power supply and a third node;

seventh and eighth MOS transistors connected in series between said power supply and a fourth node, wherein a gate terminal of said fifth and seventh transistors are mutually connected to a gate of a second current sourcing transistor, and wherein a gate terminal of said sixth and eighth transistors are mutually connected;

a positive temperature dependent current extending through a primary resistor configured between said second node and a diode-connected ground supply;

a negative temperature dependent current extending through a secondary resistor connected between said fourth node and said ground supply;

a current source output coupled to receive a sum of said positive and negative temperature dependent currents from said first and second sourcing transistors; and a startup circuit configured to supply a first initial voltage to the gate terminals of said first and third transistors and a second initial voltage to the gate terminals of said second and fourth transistors, wherein said first initial voltage activates said first and third transistors and said second initial voltage activates said second and fourth transistors.

2. The current source as recited in claim 1, wherein said second, third, sixth and seventh transistors each comprise mutually connected gate and drain terminals.

3. The current source as recited in claim 1, further comprising a first diode coupled between said first node and said ground supply, and a second diode coupled between said third node and said ground supply.

4. The current source as recited in claim 3, further comprising a third diode coupled in series with said primary resistor between said second node and said ground supply.

5. The current source as recited in claim 1, wherein a voltage at said first node is equal to a voltage at said second node.

6. The current source as recited in claim 1, wherein a voltage at said third node is equal to a voltage at said fourth node.

7. The current source as recited in claim 1, wherein the current through said first node is equal to said positive temperature dependent current.

8. The current source as recited in claim 1, wherein the current through said third node is equal to said negative temperature dependent current.

9. The current source as recited in claim 1, wherein said positive temperature dependent current increases in magnitude as temperature increases.

10. The current source as recited in claim 1, wherein said negative temperature dependent current decreases in magnitude as temperature increases.

11. A current source, comprising:

a series connected first pair of MOS transistors configured to produce a positive temperature dependent current which is mirrored through a first current sourcing transistor;

a series connected second pair of MOS transistors configured to produce a negative temperature dependent current which is mirrored through a second current sourcing transistor;

a current source output coupled to receive a sum of said positive and negative temperature dependent currents from said first and second sourcing transistors, wherein the sum of said positive and negative temperature dependent currents is temperature independent; and a startup circuit configured to supply a first initial voltage to the gate terminal of one of said first pair of transistors and a second initial voltage to the gate terminal of the other one of said first pair of transistors, wherein said first and second initial voltages activate said first pair of transistors.

12. The current source as recited in claim 11, wherein said positive temperature dependent current increases with an increase in temperature, and said negative temperature dependent current decreases with an increase in temperature.

13. The current source as recited in claim 12, wherein the rate in which said positive temperature dependent current increases is substantially equal to the rate in which said negative temperature dependent current decreases.

14. The current source as recited in claim 11, further comprising:

a series connected diode and primary resistor connected between said first pair of transistors and a ground supply, wherein said positive temperature dependent current extends through said primary resistor.

15. The current source as recited in claim 14, further comprising:

a secondary resistor connected between said second pair of transistors and said ground supply, wherein said negative temperature dependent current extends through said secondary resistor.

16. A method for producing temperature independent current from a current source output, comprising:

supplying a first initial voltage to the gate terminal of one of a series-connected first pair of transistors and a second initial voltage to the gate terminal of the other one of said series-connected first pair of transistors, wherein said first and second initial voltages activate said series-connected first pair of transistors;

mirroring a current which increases as a function of temperature from a source-drain path of said series-connected first pair of transistors to a source-drain path of a first current sourcing transistor;

mirroring a current which decreases as a function of temperature from a source-drain path of a series-connected second pair of transistors to a source-drain path of a second current sourcing transistor; and connecting the source-drain paths of said first and second current sourcing transistors to the current source output to result in a temperature independent current produced therefrom.

17. The method as recited in claim 16, wherein said mirroring a current which increases comprises:

configuring one of the first pair of transistors to be of substantially equal size to said first current sourcing transistor; and coupling a gate terminal of said one the first pair of transistors with a gate terminal of said first current sourcing transistor.

18. The method as recited in claim 16, wherein said mirroring a current which increases comprises:

configuring one of the second pair of transistors to be of substantially equal size to said second current sourcing transistor; and coupling a gate terminal of said one the second pair of transistors with a gate terminal of said second current sourcing transistor.

19. The method as recited in claim 16, wherein the rate in which the rate of increase of said current which increases as a function of temperature is substantially equal to the rate of decrease of said current which decreases as a function of temperature.

* * * * *